US008197322B2

(12) United States Patent
Berman

(10) Patent No.: US 8,197,322 B2
(45) Date of Patent: Jun. 12, 2012

(54) SYSTEM, APPARATUS, AND METHOD FOR CONFIGURING GAMING EXPERIENCES

(75) Inventor: Bradley Berman, Minnetonka, MN (US)

(73) Assignee: King Show Games, Inc., Minnetonka, MN (US)

( * ) Notice: Subject to any disclaimer, the term of this patent is extended or adjusted under 35 U.S.C. 154(b) by 1226 days.

(21) Appl. No.: 11/796,558

(22) Filed: Apr. 27, 2007

(65) Prior Publication Data

US 2007/0265055 A1 Nov. 15, 2007

Related U.S. Application Data

(60) Provisional application No. 60/795,881, filed on Apr. 28, 2006.

(51) Int. Cl.
*A63F 9/24* (2006.01)

(52) U.S. Cl. ..... 463/16; 436/42

(58) Field of Classification Search ..... 463/16, 463/42

See application file for complete search history.

(56) References Cited

U.S. PATENT DOCUMENTS

| | | | | |
|---|---|---|---|---|
| 5,989,121 | A * | 11/1999 | Sakamoto | 463/20 |
| 6,068,552 | A * | 5/2000 | Walker et al. | 463/21 |
| 6,264,560 | B1 * | 7/2001 | Goldberg et al. | 463/42 |
| 6,270,409 | B1 * | 8/2001 | Shuster | 463/20 |
| 6,695,697 | B1 * | 2/2004 | Okada | 463/20 |
| 7,465,232 | B2 * | 12/2008 | Okada | 463/42 |
| 2001/0036857 | A1 * | 11/2001 | Mothwurf et al. | 463/25 |
| 2002/0142815 | A1 * | 10/2002 | Candelore | 463/1 |
| 2002/0142825 | A1 * | 10/2002 | Lark et al. | 463/16 |
| 2002/0142846 | A1 * | 10/2002 | Paulsen | 463/43 |
| 2003/0078101 | A1 * | 4/2003 | Schneider et al. | 463/42 |
| 2005/0282607 | A1 * | 12/2005 | Gauselmann | 463/16 |
| 2007/0054738 | A1 * | 3/2007 | Muir | 463/42 |

* cited by examiner

*Primary Examiner* — Masud Ahmed

(74) *Attorney, Agent, or Firm* — Hollingsworth & Funk, LLC

(57) ABSTRACT

Apparatuses and methods for facilitating access to a plurality of gaming activities via a processing arrangement involve facilitating player identification of a set of gaming activities selected from the plurality of gaming activities. A collection of references are assigned to the set of the gaming activities. Each of the references refers to at least one of gaming activities of the set of gaming activities identified by the player. The collection of references is stored in a computer-readable medium, and player access to the set of gaming activities is facilitated using the stored collection of references.

8 Claims, 12 Drawing Sheets

400

| | 402 | 404 | 406 | 408 | 410 |
|---|---|---|---|---|---|
| | # | ACTIVITY NAME | WT | ACTIVITY REF | # REPS |
| 412 | 1 | ACTIVITY 1 | 3 | file://usr/games/a1 | 5 |
| 414 | 2 | ACTIVITY 2 | 5 | file://usr/games/a2 | 5 |
| | 3 | ACTIVITY 3 | 2 | file://usr/games/a3 | * |
| | 4 | ACTIVITY 4 | 1 | file://usr/games/a4 | 2 |
| 416 | 5 | ACTIVITY 5 | 1 | file://svr2.local/usr/games/a5 | 0 |
| 418 | 6 | ACTIVITY 6 | 3 | http://srv2.local/a6.html | 4 |
| 420 | 7 | ACTIVITY 7 | 5 | file://usr/games/a7 | * |
| | ⋮ | | | | |
| | *n* | ACTIVITY *n* | 5 | URI-*n* | * |

*FIG. 4*

SYSTEM, APPARATUS, AND METHOD FOR CONFIGURING GAMING EXPERIENCES

RELATED APPLICATIONS

This application claims the benefit of Provisional Application No. 60/795,881, filed on Apr. 28, 2006, to which priority is claimed pursuant to 35 U.S.C. §119(e), and which is hereby incorporated herein by reference in its entirety.

FIELD OF THE INVENTION

This invention relates in general to games, and more particularly to apparatuses and methods for facilitating user configurable play experiences in multiple gaming environments.

BACKGROUND OF THE INVENTION

Casino games such as poker, slots, and craps have long been enjoyed as a means of entertainment. Almost any game that can be played using traditional apparatus (e.g., cards, dice) can be simulated on a computer. The popularity of casino gambling with wagering continues to increase, as does recreational gambling such as non-wagering computer game gambling.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Another advantage to computerized gaming is that the game play itself is easily modifiable. For example, unlike a mechanical slot machine, a computerized slot machine can easily offer a player a wide variety in the number of reels and payoff options, as well as other options such as progressive or non-progressive play. The networkability of such machines can also be advantageous, not only from a centralized maintenance standpoint, but to enhance game play. For example, a group of slot machines can be grouped together so that a progressive payoff is calculated from the combined results of the individual machines.

Although computerized game machines are highly configurable, the typical setup is to have a single game per apparatus. This is sometimes dictated by controls and graphics applied to the machines, however such concerns may not be critical to all players. However, if a machine only supports one game, and a player wishes for more games, the player must leave the current machine and try to find another open machine that has a game that the player wants to play next.

Accordingly, there is a need in the gaming industry for a manner of introducing anticipation and excitement for players participating in gaming activities by providing players a mixture of gaming experiences in a single session. A further need exists to allow the player to guide some aspects of the experience based on preferences, yet still provide enough unexpected variation in order to make the collective experience of the game activities more interesting and challenging. The present invention fulfills these and other needs, and offers other advantages over prior art gaming approaches.

SUMMARY OF THE INVENTION

To overcome limitations in the prior art described above, and to overcome other limitations that will become apparent upon reading and understanding the present specification, the present invention discloses apparatuses and methods for facilitating multiple configuration gaming experiences.

In accordance with one embodiment of the invention, a method is provided for providing access to a plurality of gaming activities via a processing arrangement. The method involves facilitating player identification of a set of gaming activities selected from the plurality of gaming activities. A collection of references is assigned to the set of the gaming activities. Each of the references refers to at least one of gaming activities of the set of gaming activities identified by the player. The collection of references is stored in a computer-readable medium. Player access to the set of gaming activities is facilitated using the stored collection of references.

In more particular embodiments, facilitating player access to the set of gaming activities using the stored collection of references involves determining a sequence of the gaming activities based on the stored collection of references. Progression of the sequence may be based on a playing time of the gaming activities of the sequence, a player input indicating desire to progress the sequence, random order and/or a predetermined event occurring within the gaming activities of the sequence. The predetermined event may include a predetermined number of completed play events within each gaming activity. The completed number of predetermined number of completed play events within each gaming activity may include a variable number of events that is varied based on an order of the gaming activity within the sequence and/or a predetermined number of win-loss events within each gaming activity.

In other, more particular embodiments, the method further involves associating a weighting with each of the references in the collection, such that a probability of the player being facilitated access to the gaming activities associated with each reference is based on the weighting associated with each reference. The method may also include facilitating access to the collection of references using a portable persistent data storage medium, and/or coupling the portable persistent data storage medium to any of a plurality of data processing apparatuses to facilitate player access to the set of gaming activities.

In other, more particular embodiments, the method further involves facilitating the sharing of the collection of references with other players. The method may also involve storing of a plurality of predefined collections having references to predefined sets of gaming activities, such that facilitating player identification of the set of the gaming activities involves facilitating player selection of one or more collections of the predefined collections.

In another embodiment of the invention, a casino gaming apparatus hosts a gaming activity, and includes a human input and output capable of providing player access to a plurality of gaming activities. A processor is coupled to the human input and output, and a memory is coupled to the processor. The memory has instructions that cause the processor to facilitate player identification of a set of gaming activities selected from the plurality of gaming activities. A collection of references is assigned to the set of the gaming activities. Each of the references refers to at least one of gaming activities of the set of gaming activities identified by the player. The instructions also cause the processor to store the collection of references in a computer-readable medium, and facilitate player access to the set of gaming activities via the human input and output using the stored collection of references.

In another embodiment of the invention, a computer-readable medium has computer-executable instructions stored thereon and executable by a processing system for facilitating participation in a plurality of gaming activities. The computer-executable instructions performing steps including 1) facilitating player identification of a set of gaming activities selected from the plurality of gaming activities; 2) assigning a collection of references to the set of the gaming activities, wherein each of the references refers to at least one of gaming activities of the set of gaming activities identified by the player; 3) storing the collection of references in a second computer-readable medium; and 4) facilitating player access to the set of gaming activities using the stored collection of references.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described representative examples of systems, apparatuses, and methods in accordance with the invention described in connection with the embodiments illustrated in the following diagrams.

BRIEF DESCRIPTION OF THE DRAWINGS

The invention is described in connection with the embodiments illustrated in the following diagrams.

FIG. 4 illustrates an example data structure suitable for representing a collection of gaming activities in accordance with one embodiment of the present invention;

DETAILED DESCRIPTION OF THE INVENTION

In the following description of various exemplary embodiments, reference is made to the accompanying drawings that form a part hereof, and in which is shown by way of illustration various embodiments in which the invention may be practiced. It is to be understood that other embodiments may be utilized, as structural and operational changes may be made without departing from the scope of the present invention.

Generally, the present invention relates to providing a configurable gaming experience that utilizes a variety of different gaming activities from a single playing location, such via as a standalone, computerized gaming machine. In various forms, the invention allows players to define a personal collection of playing activities. The playing activities may be defined as specific games (e.g., a particular themed slot game), game categories (e.g., four-reel non-progressive slots) or other grouping of gaming activities (e.g., casino's five most popular). Generally, the player can define a set of gaming activities, and use this defined set to cause a gaming machine to produce a sequence of gaming activities. The sequence may be advanced (e.g., change from one game to the next) based on many factors, including time, events occurring within a game, win-losses within a game, and/or based on random selection.

Figure 1:
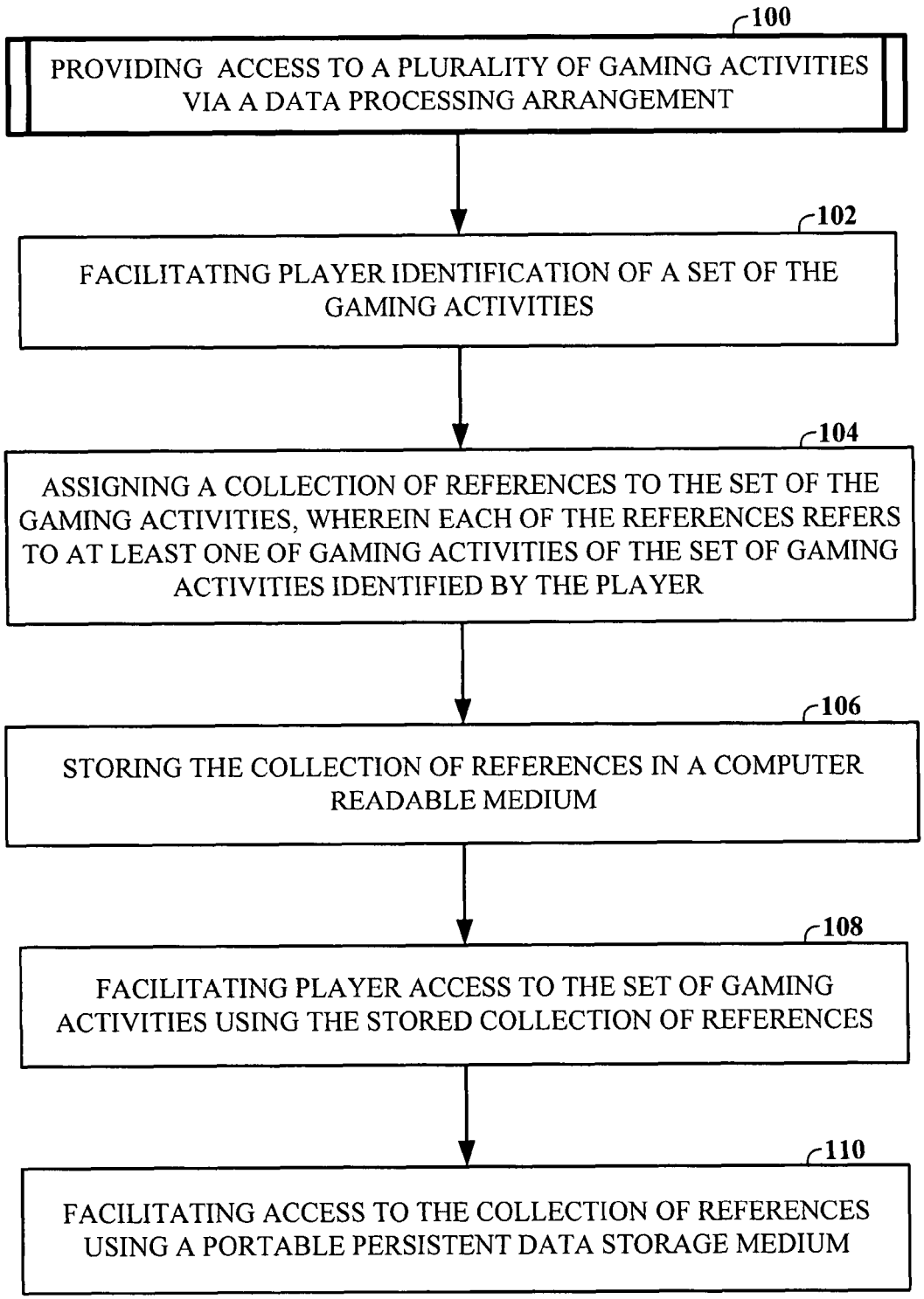
FIG. 1. is a flow diagram illustrating a manner of providing access to a plurality of gaming activities in accordance with one embodiment of the present invention.

In reference now to FIG. 1, a flow diagram illustrates a manner 100 of providing access to a plurality of gaming activities in accordance with one embodiment of the present invention. The gaming activities are typically implemented on a data processing arrangement, and such games may be invoked, in whole or in part, on a processor-implemented gaming apparatus. As such, the activities are usually implemented as computer executable instructions, such as binary objects, scripts, etc. A player is facilitated 102 in identifying a set of gaming activities of the user's choice. These activities may be defined generically or specifically. For example, the player could select an entire category of Hold 'em style poker games, which may include a plurality of different individual instantiations of this type of game. In addition, the player could select preferred individual instantiations of draw and stud poker games to add to the set. Besides choosing the games, the player may also be facilitated 102 in choosing/defining an identifier for the set, the order of the games, and/or sequencing criteria that cause the next game in the set to be chosen.

The choices made by the player are used to form a collection of references that are assigned 104 to the selected set of gaming activities. Each of the references refers to one or more of the gaming activities within the identified set. The references ultimately allow the target gaming activity to be accessed. The references may include a name, numeric identifier, file descriptor, path name, Universal Resource Identifier (URI), database reference, or any other symbol that may be used to provide user access to the target gaming activity. It will be appreciated that the collection may include the gaming activities themselves. For example, where the gaming activities comprise processor executable instructions, the collection may include binary instructions (e.g., files) that cause the game to operate. Even so, the collection will more typically contain a reference to the target gaming activity for purposes of data compactness, ease of maintenance, and portability. However, the terms "gaming activity" and "reference to a gaming activity" may be used interchangeably herein. Those skilled in the art will appreciate that either meaning may be equally applicable to the embodiments described herein.

Generally, the collection of references are a part of a processor readable data structure used to create, use, and maintain the player's preferences relating to the gaming activities. The collection may be formed 104 using any data structure known in the art, including an array, singly/doubly linked list, hash set, binary tree, etc. To allow processor access to the collection, the collection is stored 106 in a computer readable medium. Such computer readable medium include, but are not limited to, magnetic media (e.g., hard drives, tape, smart cards), optical media (e.g., compact disc, bar codes, holographic images) and solid state media (Random Access Memory, Read-Only Memory, flash memory). The stored references can be used to facilitate player access 108 to the set of gaming activities. This access 108 may generally involve retrieval of the stored references, which are then used to enable the player to engage in the gaming activities described by the references.

Optionally, the collection of reference data (or a reference to the collection) may be stored and accessed 110 by a portable persistent data storage medium. This may allow, for example, the player to carry the collection around on a credit-card like medium, and later access the collection on different gaming apparatus. The collection itself could be stored on the media, or be stored on a server element that is accessible from gaming apparatus. In the latter case, the portable media only needs to carry a reference to the collection so that it may be retrieved from any physical location in order to begin gaming according to the stored preferences.

Figure 2:
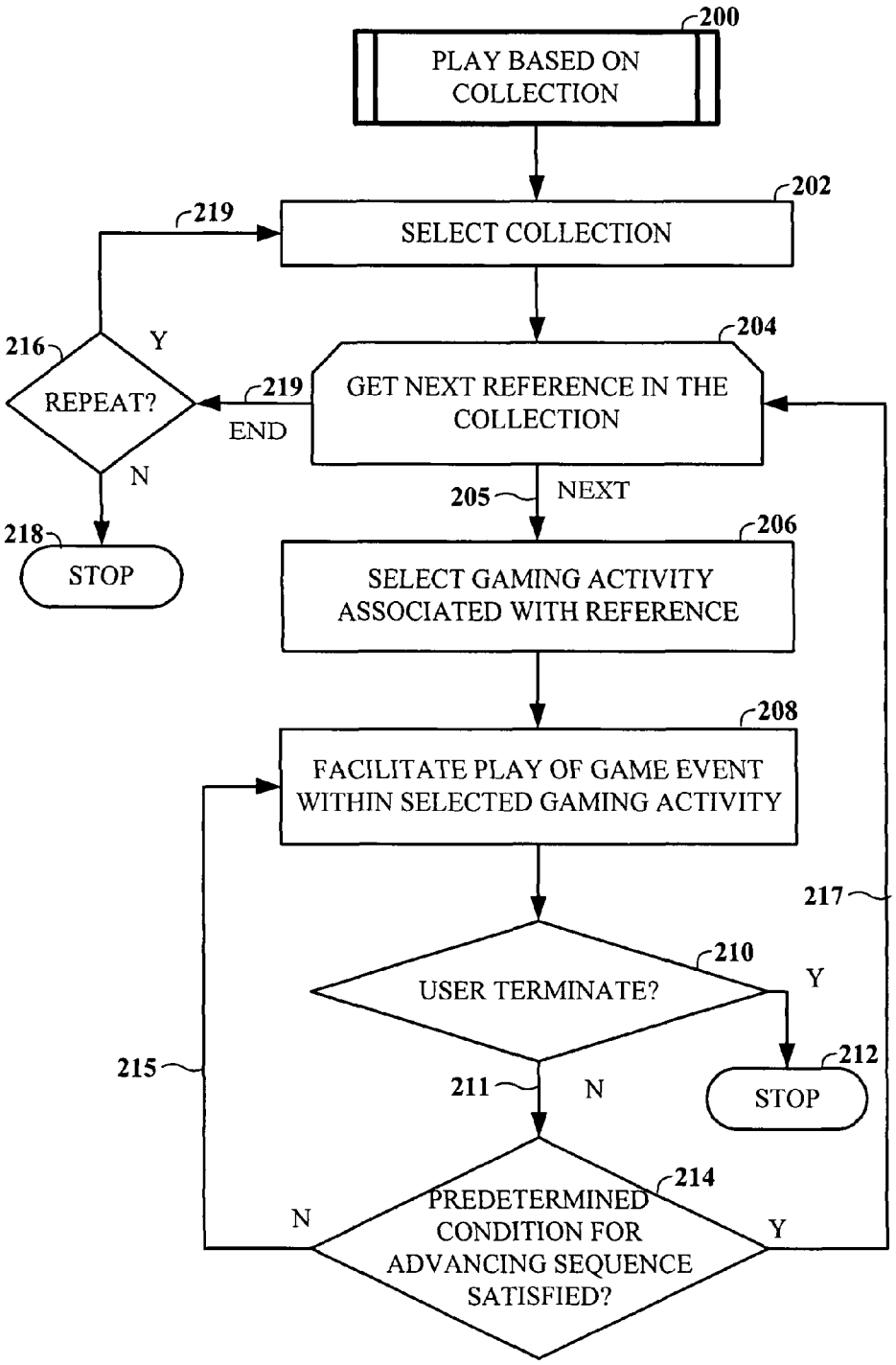
FIG. 2 is a flow diagram illustrating a manner of game play based on a collection of gaming activities in accordance with one embodiment of the present invention.

An example manner of how stored collections of data may be used to facilitate play activities in accordance with an embodiment of the invention is illustrated in the flowchart of FIG. 2. The procedure 200 assumes the player has already formed a collection of gaming activities and that collection is made available at the appropriate gaming apparatus. The appropriate collection is selected 202 either manually or automatically. For example, the collection may be selected automatically when the player's identity is determined, such as by the use of a smart card or proximity device that interfaces with the apparatus. Typically, the player will at least have the option of manually selecting one or more collections. These manually selected collections may be ones that the player has compiled, or collections that are "canned" or preconfigured for general use.

Once a collection has been selected 202, the collection is iterated through, and indicated by the loop limit 204, where each next reference in the list is determined. Assuming a next reference exists (path 205), the gaming activity associated with the reference is selected 206. In a conventional data processing apparatus, this generally involves loading the program instructions into memory and executing the instructions. Once the gaming activity is selected 206, the player begins playing 208 a discrete game event, such as a hand of cards or a spin of a slot machine. At the completion of these discrete events 208, the player may choose to terminate 210 play completely, upon which the routine exits 212. If the player wishes to continue, however (path 211), then it must be determined 214 whether to continue playing events within the same activity (path 215) or to select the next gaming activity 204 from the collection (path 217).

The determination 214 of whether to advance the sequence (and thereby select a new activity 204) may be set within fixed parameters of the routine 200, or may be user configurable. For example, the default may be to play five rounds of poker and five spins of a slot machine game. However, the user may be able to select other values on which to base the determination 214. The determination 214 may be based on play events, time, play results (e.g., win/loss), or be entirely random. When the collection is empty (path 219), the user may be prompted to decide whether to repeat 216 this collection, or select 202 another collection (path 219). If not, then the routine ends 218. The example procedures in FIGS. 1 and 2 are presented for purposes of illustration, and the order and existence of the steps may vary from those illustrated.

Figure 3:
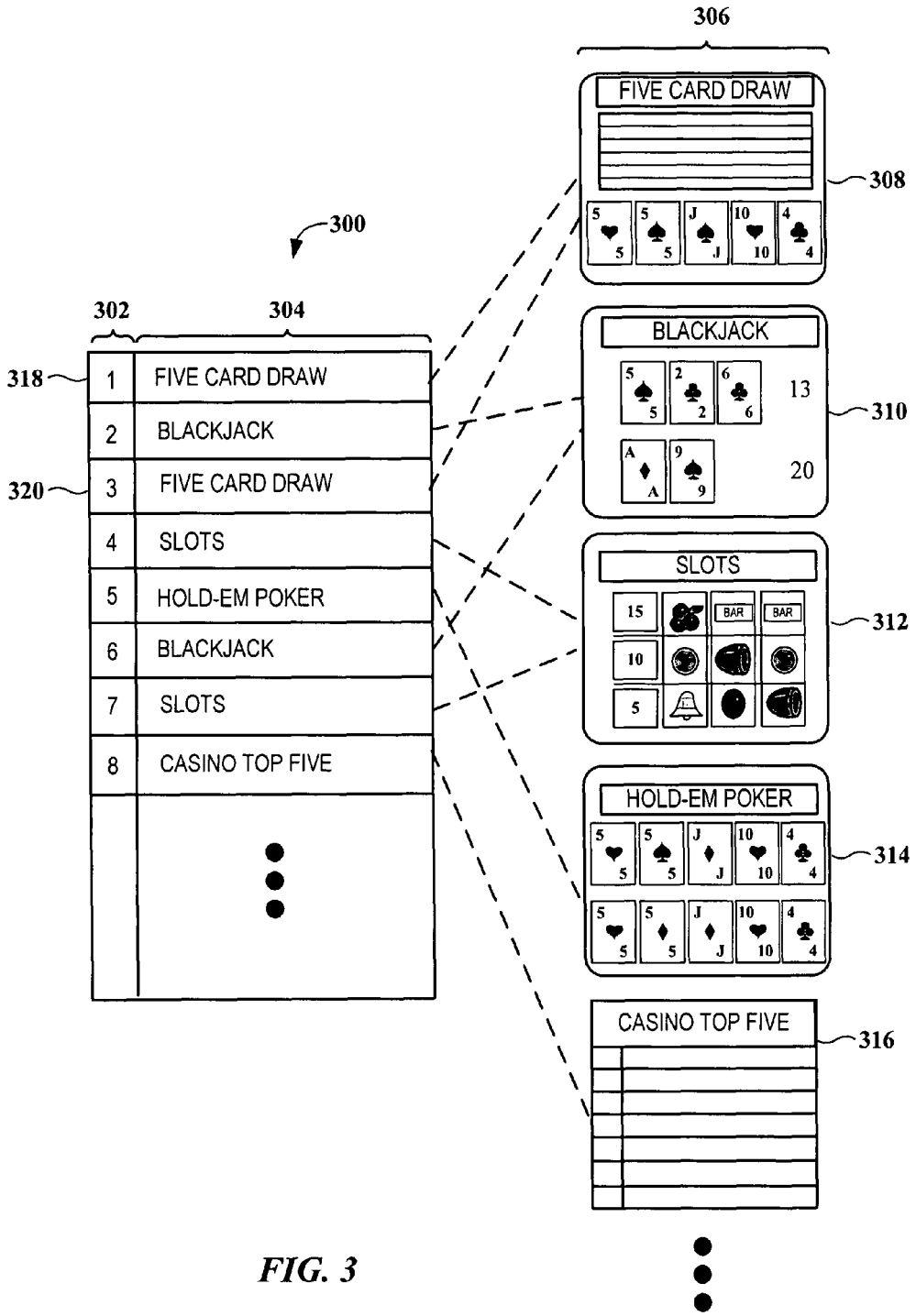
FIG. 3 illustrates a representative collection of gaming activities in accordance with one embodiment of the present invention.

Turning now to FIG. 3, a block diagram shows a more particular example of a collection 300 of gaming activity references according to an embodiment of the invention. The example collection includes two columns, an index column 302 and a reference column 304. Those skilled in the art will recognize that the index column 302 is not always necessary, because many data collection structures (e.g., linked lists) do not require indices. The references column 304 in this example contains the name of the actual gaming activity, which is selected from the set 306 of gaming activities represented on the right of the figure. These activities 306 may include processor implemented games such as five card draw 308, blackjack 310, slots 312, and Hold 'em poker 314. The activities 306 may also include other collections, such as the example Casino Top Five collection 316. Generally, the collection 300 may include any number of nested levels of other collections, although it will be appreciated that eventually a gaming program (e.g., games 308, 310, 312, 314) or other activity will ultimately be determined in order for the player to play through the collection 300.

A gaming apparatus may retrieve the collection 300 and play through each reference 304 in the order listed, or in any other order (e.g., randomly). Note that identical references to the same activity may be included in multiple rows, such as the "Five Card Draw" reference in locations 318 and 320. In one implementation, each row in the collection 300 may represent a single play event (e.g., hand of cards or spin of slot machine), or represent some other predetermined number of events. If the events are for a predetermined number, the number of play events could be different depending on the type of game. In another implementation, the events could be unlimited, being terminated by the player's express indication to advance the sequence to the next gaming activity.

A more detailed example of a collection data structure 400 according to an embodiment of the present invention is presented in FIG. 4. The illustrated collection 400 includes additional user configurable data that the player may use to more closely tailor the gaming experience to the player's preferences. The example collection 400 includes columns that represent indices 402, human-readable names of the gaming activities 404, weightings 406, references 408, and numbers of repetitions 410. Although not always necessary, the indices 402 and activity names 404 data may be useful in presentation of the data to end users, as well as for troubleshooting by programmers.

The weighting data 406 may be used to influence the probability of each activity being chosen relative to the other activities. The weighting 406 will typically be a factor when the activities are selected at random from the collection 400. In the illustrated example, the weighting values 406 are integers from one to five, with a higher number indicating a higher probability of the activity being selected. For example, Activity 1 at row 412 has a three weighting, where Activity 2 at row 414 has a five weighting. Therefore, all things being equal, Activity 2 has a higher probability of being chosen.

Various weighting and selection schemes may be used to determine the actual probability of each row/activity being chosen.

A typical weighted selection scheme may involve selecting each activity in proportion to its weight as compared to the sum of all weighting values 406. The probability ($p_i$) of an individual activity-i occurring within a collection of n-activities, where activity-i has weighting $w_i$, may be expressed as:

$$p_i = \frac{w_i}{\sum_{i=1}^{n} w_i} \quad (1)$$

For example, if the sum of all the weighting values 406 was 100, then the probability of row 412 being selected is 3/100=3% and the probability of row 414 is 5%. Other weighted selection schemes include floor/ceiling type selections. For example, a floor of three could be defined, and only activities having a weighting of three or above would be chosen when this selection scheme is active. It will be appreciated that, even where the weightings 406 are not used to select probability of activity selection, such weightings are useful for both players and game vendors/operators. The weightings can act as a "star" rating system, whereby players can remember game activities that were particularly enjoyable. Such weightings and preferences can also be useful to gaming operators to determine popularity of games, not only as a whole (which may also be gauged in other ways) but as to determine popularity among particular identities or types of players (e.g., high rollers).

The activity references 408 are generally useful to the underlying programs that are used to select and run game activities. In the illustrated collection 400, the activity references 408 are in the form of Universal Resource Identifiers (URI). The URI (such as the reference "file://usr/games/a1" in row 412) may point to a local or network attached executable image. In row 416, the URI references a file that is explicitly defined as being on a remote host, here accessible at hostname "svr2.local." When a local filename is used, the local file system protocol is used to retrieve the gaming activity (e.g., FAT32, NTFS, ext2, ext3, etc.) However, when a remote host is defined, a network file system such as Server Message Block (SMB) or Network File System (NFS) may be used to retrieve the file. Other protocols may also be used to load game. For example, row 418 references a Hypertext Transport Protocol (HTTP) object, such as might be retrieved from a Web server. The object retrieved based on this reference 418 may be any combination of a Hypertext Markup Language (HTML) document, binary display image, executable object, etc. Other protocol identifiers that may be similarly used in the URIs 408 include ftp, smb, telnet, etc.

As previously described above, each of the gaming activities typically include a number of repeatable, discrete events, such as hands, spins, rolls, etc. It may be desirable to allow the user to designate the number of these events to present by default. This is one manner in which the repetitions column 410 may be used. For example, assuming Activity 1 in row 412 is a video poker game, it would be set here to play five hands each time the activity 412 is selected. Certain special values may have a particular meaning in the context of the end gaming system. For example, a value of zero repetitions as in row 416 may indicate that the repetition number is indefinite, and that Activity 6 is to continue until the player expressly chooses to quit or change games. For some activities such as progressive slots, where the odds or amount of winnings may change on successive plays, it may be preferable to allow the user to decide when to terminate the activity, rather than having the activity terminate automatically.

Another special value indicated in the repetitions column 410 is the "*" symbol, such as shown in row 420. This may indicate that there is no preference, and some global default behavior may be applied to this activity. In strongly typed systems such as databases, a mixture of numerals and symbols may be inefficient or not allowed. In such an arrangement, another number unusable to indicate repetitions, such as −1, may be used instead of a symbol.

It will be appreciated that many different schemes may be utilized in determining the number of events within each activity that the player actually plays before transitioning to the next activity in the collection. In reference now to FIGS. 5A-D, various sequencing schemes are illustrated according to embodiments of the invention, and wherein the same reference characters are used to describe elements corresponding to similar elements in all of FIGS. 5A-D. Generally, the sequencing schemes are illustrated on a timeline 500, wherein markers 502, 504, 506, and 508 delimit approximately equal time divisions on the timelines 500. The boxes in the diagrams illustrate discrete events within a gaming activity, wherein events within the same activity have the same shading pattern. For example, the first three unshaded boxes 510 may represent three hands of draw poker, and the next shaded boxes 512 represent five spins on a slot machine game, etc.

Figure 5A:
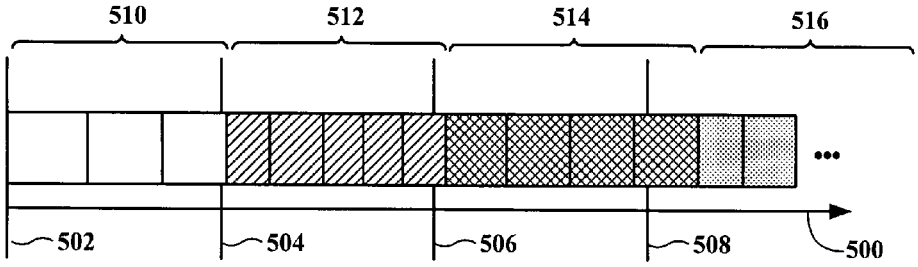
FIGS. 5A-D are timelines illustrating various schemes from transitioning between gaming activities in accordance with embodiments of the present invention.

FIG. 5A illustrates a sequence that advances between four activities 510, 512, 514, and 516. The transition between activities 510, 512, 514, and 516 is based on the elapsed time within each activity. Generally, whenever play within the activity exceeds a certain time as represented by the markers 502, 504, 506, and 508, then a transition to the next activity occurs. In the illustrated diagram, the markers are measured relative to a constant baseline, marker 502. However, a time based system can also be triggered based on the last sequence transition. For example, the timeout of activity 514 would be based on the time when activity 514 began (and activity 512 ended) rather than the marker 508. Regardless of how the transition times are baselined, it may be quite common for different activities to have more events than others for a given amount of time. For example, there are only three events occurring in activity 510 as opposed to five for activity 512, even though both occur in approximately the same amount of time.

Figure 5B:
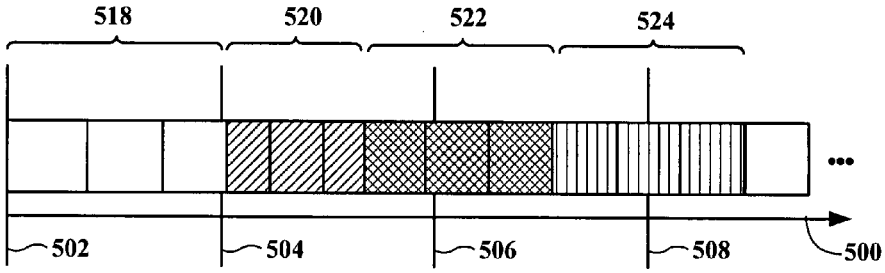

The sequence in FIG. 5B illustrates the case where a fixed or predetermined number of discrete events occur within each gaming activity 518, 520, 522, 524 before advancing to the next gaming activity. Here the transition occurs after three events. Because events within some activities, such as activity 520, take less time than events within other activities, the time spent within each activity 518, 520, 522, 524 may be different.

Figure 5C:
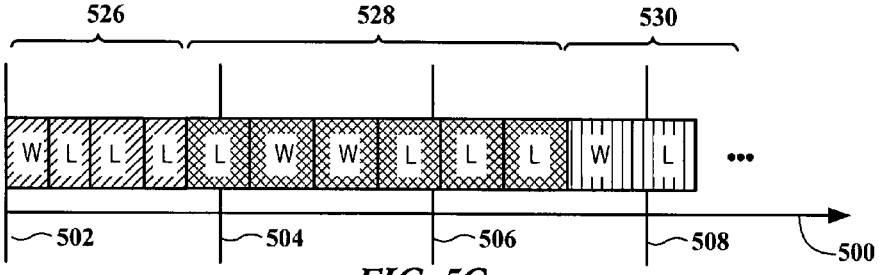

The sequences in FIGS. 5A and 5B are generally independent of the outcome of each gaming event. FIG. 5C illustrates a sequence that is dependent on the outcome of each gaming event, in particular a win/loss outcome. In this example, a string of three consecutive losses will cause the sequence to shift between the gaming activities. Thus, each of the activities 526, 528, and 530 may continue indefinitely so long as the player does not lose three events in a row. The definition of winning and losing may be defined differently between each type of game. Usually a net monetary gain for the event would be considered winning, and a net monetary loss for the event would be considered losing. A break-even event could be classified under either category.

Figure 5D:
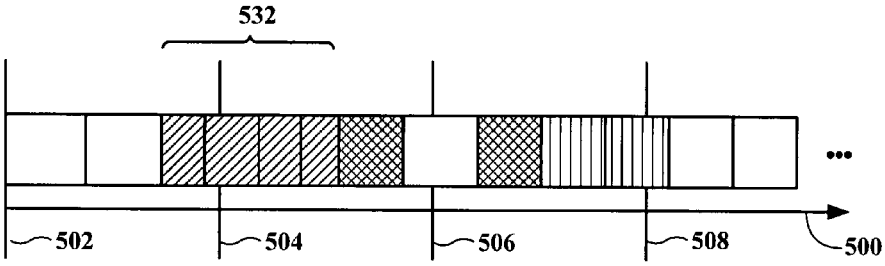

Finally, FIG. 5D illustrates a random sequence of play events. Some events may be naturally grouped together, such as events 532, which could be consecutive events in a game that is "progressive," e.g., one whose payout for a given event may be determined based on prior play events. Otherwise, it may be assumed the events are distributed in any random order, and the frequency of an individual play event may be influenced by factors such as preference weighting described above.

Figure 6:
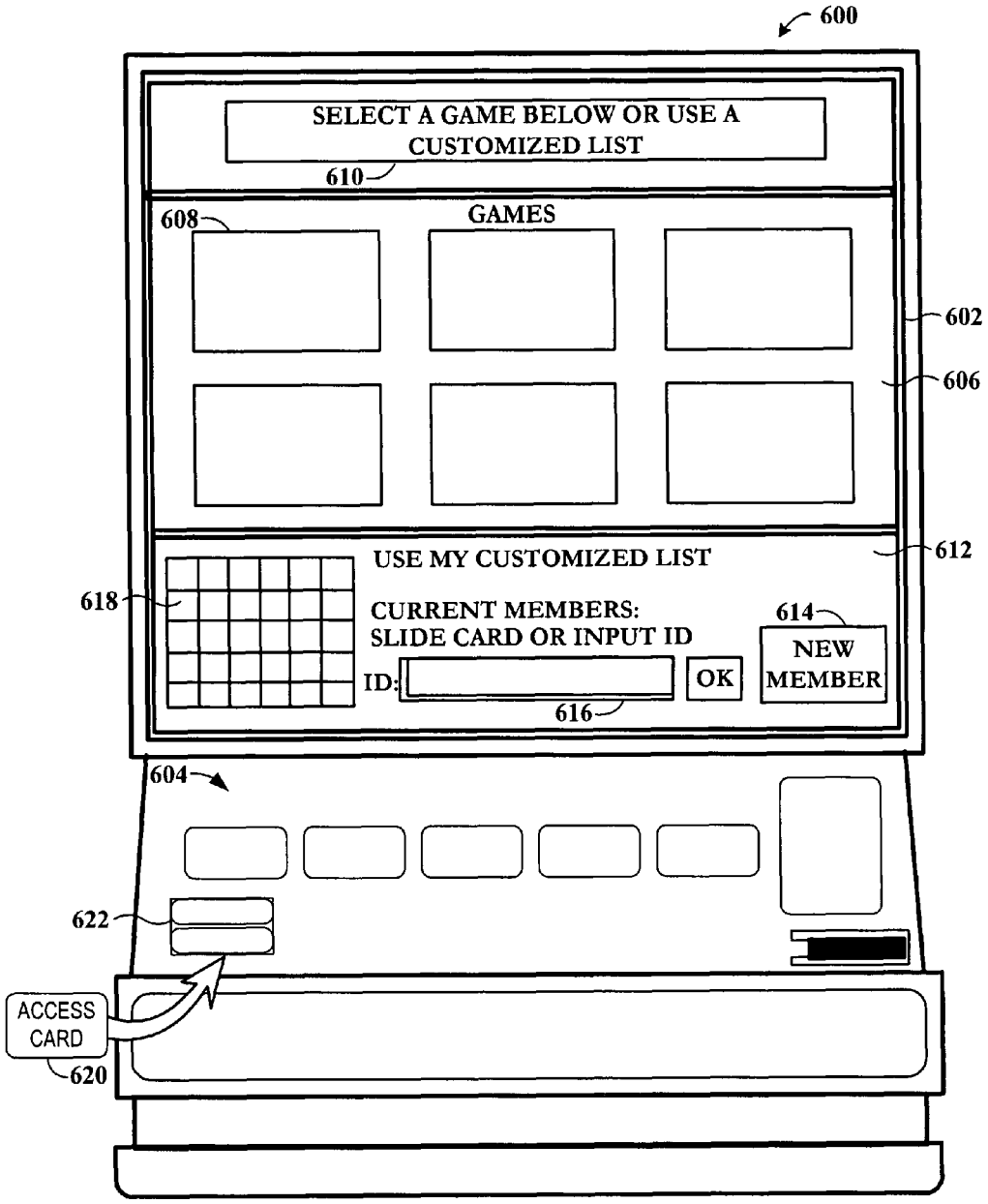
FIG. 6 a representative embodiment of a casino-style gaming device incorporating gaming collections according to an embodiment of the present invention.

A player may be able to choose any combination of sequencing arrangements such as those illustrated in FIGS. 5A-D. The sequencing choices may be made before game play, and the sequencing may be changed during game play. Generally, an apparatus that provides the individual gaming events may also include user interfaces that allow users to create, manage, and utilize gaming activities as described herein. The present invention may be implemented in different manners, such as via a live table game or an electronic embodiment. FIG. 6 illustrates a representative embodiment of a casino-style gaming device in which the principles of the present invention may be applied. For purposes of explanation, the description of the gaming device is FIG. 6 is provided in terms of a gaming device in the form of a kiosk or console 600. However, the present invention is analogously applicable to other computer-based systems.

The illustrated gaming machine 600 includes a computing system (not shown) to carry out operations according to the invention. The illustrated gaming machine 600 includes a display 602, and a user interface 604, although some or all of the user interface may be provided via the display 602 in touch screen embodiments. The user interface 604 allows the user to control and engage in play of the gaming machine 600. The particular user interface mechanisms associated with user interface 604 is dependent on the type of gaming machine. For example, the user interface 604 may include one or more buttons, switches, joysticks, levers, pull-down handles, trackballs, voice-activated input, or any other user input system or mechanism that allows the user to play the particular gaming activity.

In the particular embodiments illustrated, the gaming machine 600 may support a wide variety of different games playable from the same machine 600. As such, the user interface 604 may be generalized and programmable to support a number of different games. For example, various controls of the user interface 604 may have different functions depending on the current game being played. These different functions could be indicated by a menu or labels provided on the display 602, wherein the labels describe the function performed by each control for the current game. In other arrangements, the user interface 604 itself may have mechanical or electrical elements that denote different functions of various controls for each game. For example, buttons may built-in or nearby electronic (e.g., LED, LCD) or mechanical indicators that provide words or symbols that changeably indicate the function of each button.

The user interface 604 may allow the user to enter coins, bills, or otherwise obtain credits through vouchers, tokens, credit cards, tickets, etc. Various mechanisms for entering such vouchers, tokens, credit cards, coins, tickets, etc. are known in the art. For example, coin/token input mechanisms, card readers, credit card readers, smart card readers, punch card readers, and other mechanisms may be used to enter wagers. It is through the user interface 604 that the user can initiate and engage in a gaming activity in accordance with the invention. While the illustrated embodiment depicts various buttons for the user interface 604, it should be recognized that a wide variety of user interface options are available for use in connection with the present invention, including pressing buttons, touching a segment of a touch-screen, entering text, entering voice commands, or other known user entry methodology.

The display device 602 may include one or more of an electronic display, a mechanical display, and fixed display information such as information such as paytable information associated with a glass/plastic panel on the gaming machine 600. The cards or other indicia associated with the play of the game may be presented on an electronic display device.

Generally, the display 602 may show a default screen such as a main menu when first approached by the player. In a gaming machine 600 according embodiments of the present invention, the machine supports a variety of different games, as well as supporting user configurable gaming sequences. Therefore the player may either want to immediately select a game and begin playing, or create/modify/use a player-defined sequence of games. In the illustrated display, an immediate selection area 606 allows a player to immediately select and begin playing any available game. For example, the player may select a button 608 that includes text and/or pictures describing a particular game. Other controls, such as arrows, scroll bars, etc., (not shown) may be added to the immediate selection area to allow a large number of such buttons (or similar controls) to be accessed via multiple screens.

The immediate selection area 606 may be "flat," in that each button/control represents a single game, and activation of a control (e.g., button 608) starts immediate game play. The immediate selection area 606 may also be nested or hierarchical, such that the controls on the first screen describe a general category. Activating a first screen control causes a new screen to appear with a set of controls appropriate for the selected category. The new screen could be additional categories or specific games. For example, a first screen might have a number of controls, labeled "card games," "slots," etc., and selecting the "card games" control brings up another screen with "poker," "blackjack," etc. Those skilled in the art will appreciate that the described features of the immediate selection area 606 are for purposes of illustration and not limitation. The present invention is not specific to any method or configuration of the immediate selection area 606 or its equivalents.

Another option that may be provided to the player on the main menu is to use a personalized gaming list/collection. This capability is indicated by label 610 and list management area 612. Generally, the list management area 612 allows a player to create, access, modify, and otherwise manage collections of gaming activities. If a player has never used the list/collection function before, a new member control 614 may allow the user to establish such a list/collection. By activating the new member control 614, the player may be able to enter a personal identifier (e.g., name, personal identity data), and define and store lists/collections of playing activities to be used. The collection is associated with the personal identifier, and can later be accessed using such identifier. The collections may be centrally stored, such as on a computer server, or may be stored in a removable media carried by the player.

If the player already has a collection of games established, then the player may simply enter an ID in an entry field 616. The ID may be any alphanumeric authentication symbol, and may require the use of more than one entry field 616, such as when a username and password are used. The ID may be input via a touch screen keypad 618, or by a mechanical keypad (not shown) that may be provided with the other controls 604. Alternatively, the user may have a magnetic card 620 or other media that can be used with a reader 622. By sliding the card 620 through the reader 622, for example, the player may be able to instantly access personal collections of gaming activities, and other related data. The collections may be stored on the card 620 itself, or identity data stored on the card 620 may be used to access centrally stored data that is accessible via the gaming machine 600.

Figure 7A:
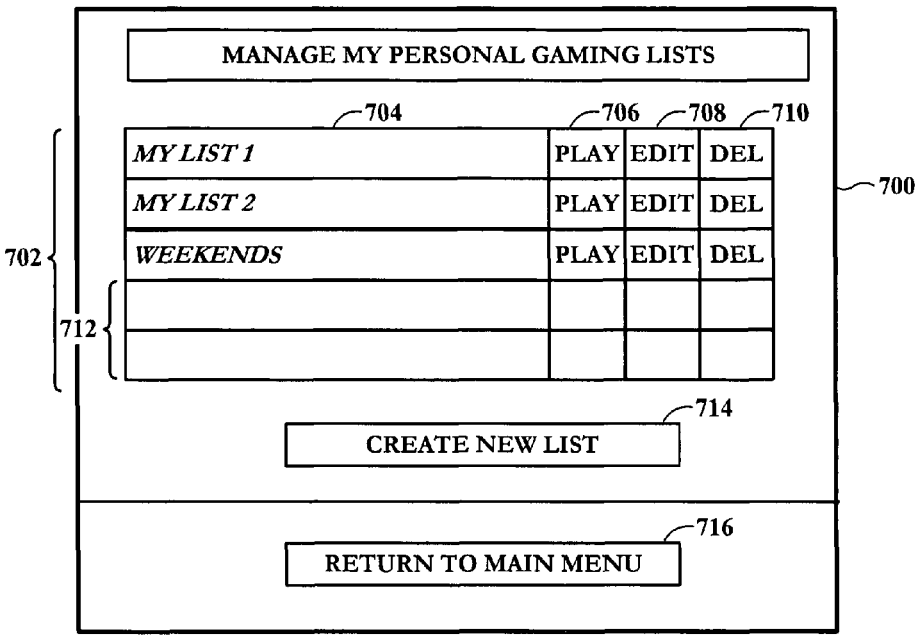
FIG. 7A illustrates an example user interface for managing personal collections of gaming activities according to an embodiment of the present invention.

After entering user data into the list management area 612, the player may be presented with alternate displays that allow the player to create, delete, modify, and utilize customized collections of game activities. An example of such a screen according to an embodiment of the invention is shown as the list management screen 700 in FIG. 7A. The list management screen 700 includes a number of rows 702, wherein each row corresponds to user-defined collection of gaming activities. Each row includes a user-defined name 704 used to identify the collection. A number of controls (e.g., buttons) in each row allows actions such as play 706, edit 708, and delete 710. A number of rows (e.g., rows 712) may be empty, indicating that there is room for the player to define and store additional collections. The player may create a new collection by way of the "create a new list" control 714, or leave the menu entirely using control 716.

Figure 7B:
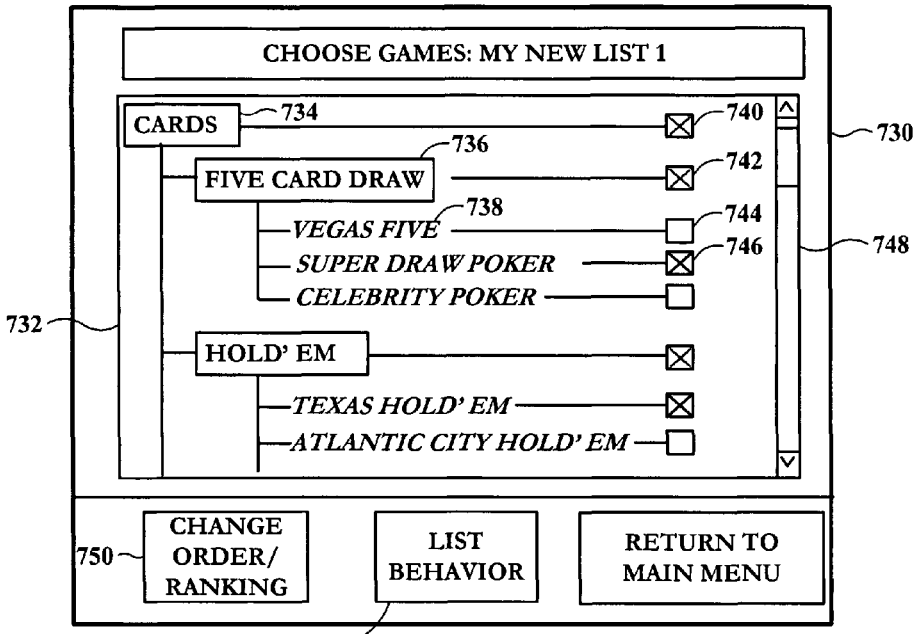
FIG. 7B illustrates an example user interface for adding to and subtracting from personal collections of gaming activities according to an embodiment of the present invention.

If the player chooses to create a new list (e.g., via control 714) or edit an existing list (e.g., via control 708), one or more list editing interfaces may be presented. An example interface 730 according to an embodiment of the invention that is usable for adding and removing gaming activities from a user-defined collection is shown in FIG. 7B. The interface 730 contains a selection area 732 that includes a description of some or all of the gaming activities available to add to the user's list. The example selection area 732 displays gaming activities in a hierarchical display. Categorical descriptions are indicated by the labels such as labels 734 and 736. Individual gaming activities are also indicated by labels (e.g., label 738) that preferably are visually distinguishable from category labels 734, 736.

The selection area 732 includes selection boxes, such as boxes 740, 742, 744, and 746. These boxes 740, 742, 744, 746 both indicate a current selection state as well as providing a means for selecting or deselecting an activity or groups of activities. As seen here, selection boxes (e.g., boxes 740, 742) may be associated with categories, thus allowing all of the activities within a category to be selected. If only a part of the activities in a category are chosen, the category selection boxes may indicate the category is selected, but grayed-out, such as is illustrated with boxes 740 and 742. The selection area 732 may include other user interface elements to assist in maneuvering, such as scroll bar 748. Those skilled in the art will realize the illustrated selection area 732 is merely exemplary, and any manner of user interface paradigm known in the art may be used to select or deselect gaming activities, including any combination of list boxes, grids, folders, direct input (typing), tabs, etc.

Figure 8A:
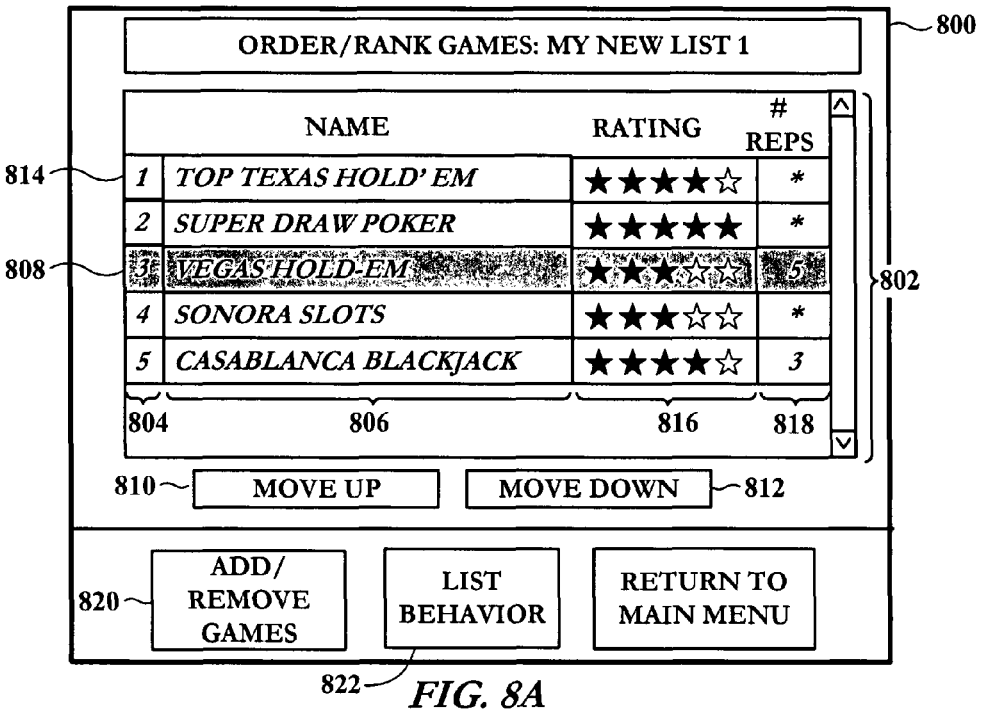
FIG. 8A illustrates an example user interface for configuring personal collections of gaming activities according to an embodiment of the present invention.

The illustrated interface 730 provides a way to add or subtract gaming activities from a user-defined collection. The player may also want to define other aspects of the gaming activates, such as sequence order and/or ranking. A control 750 provides the user access to another interface to manage these aspects of the collections. An example of such an interface 800, e.g., one usable for managing data associated with gaming activities in a user-defined collection according to an embodiment of the invention, is shown in FIG. 8A. The interface 800 includes a list 802 that represents the gaming activities in the currently selected collection. Each row in the list 802 represents a different activity. The first column 804 represents the order/index of each activity within the list, and the next column 806 displays the player-defined name of the activity.

The player may be able to change the order within the list 802 by manually editing the index entry 804. Alternatively, as illustrated in FIG. 8A, the player can select a row (e.g., row 808 is shown selected) and then the change the order through use of the "move up" 810 and "move down" 812 controls. These controls may be selectively enabled. For example, if the top row 814 in the list 802 is selected, the "move up" button 810 may be disabled.

Other columns in the list may include a ranking column 816 and a number of repetitions column 818. The ranking column 816 may help a user remember favorite games, and may be used to affect such play variables as the likelihood of a given gaming activity occurring in certain play modes (e.g., random). The repetitions column 816 may be used to define the number of play events that the player will see before the next activity in the list proceeds. Other menu options available to the player are to add or remove gaming activities represented by control 820, and other behaviors of the list, as represented by the control 822 (also see control 752 in FIG. 7B).

Figure 8B:
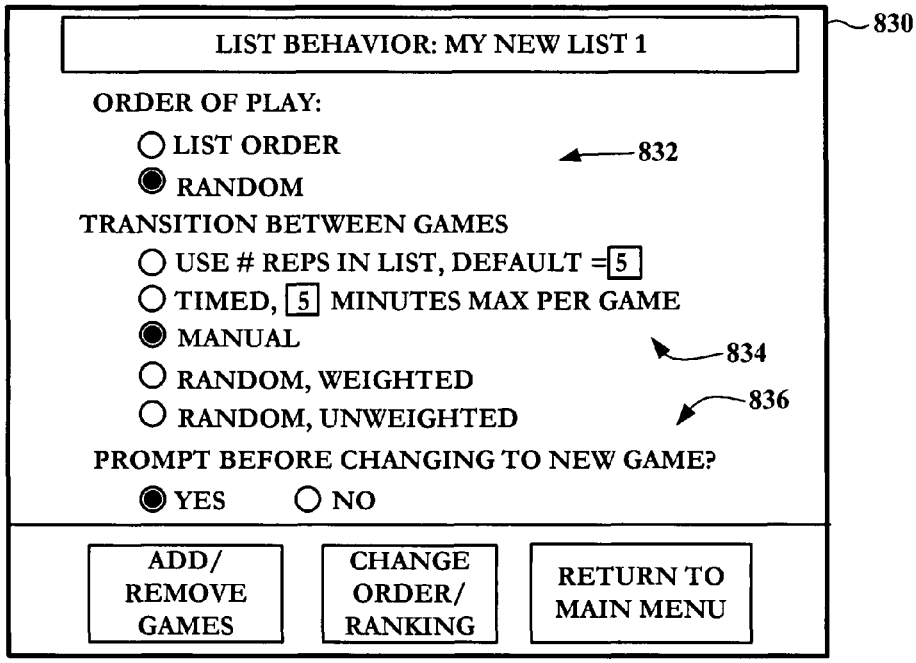
FIG. 8B illustrates an example user interface for configuring behaviors associated with personal collections of gaming activities according to an embodiment of the present invention.

The behavior of the gaming activity (e.g., sequencing from one activity to the next) may require that the user choose certain define overall gaming behaviors, as well as default actions/settings for particular activities within a collection. An example interface 830 according to an embodiment of the invention that is usable for defining default and overall game play behavior is shown in FIG. 8B. The interface includes basic selection boxes 832 that allow a player to define whether the gaming activities are played in the order of the list, or randomly. The interface 830 also includes controls 834 that allow the player to define how and when one gaming activity will end and the next will begin. The behaviors associated with these choices 834 are described more fully hereinabove in relation to FIGS. 5A-D. Another setting that may be important to players is whether to be prompted before starting a new gaming activity, and this is represented by controls 836. It will be appreciated that the form and content of the controls of the illustrated interface 830 are merely exemplary, and are provided for purposes of illustration and not limitation.

Generally, after the player has created and configured a personalized collection of gaming activities, the configuration screens of FIGS. 7B and 8A-B need not be visited again unless the player desires to make changes. After selecting a list from which to play (e.g., using an interface such as the one shown in FIG. 7A), the player can then proceed to play the gaming activities. Generally, the present invention does not depend on any particular gaming activity. The use of configurable collections may apply to any automated or computerized gaming activity, now known or later developed. However, a gaming apparatus may need to provide some features for dealing with collections/lists during game play.

Figure 9:
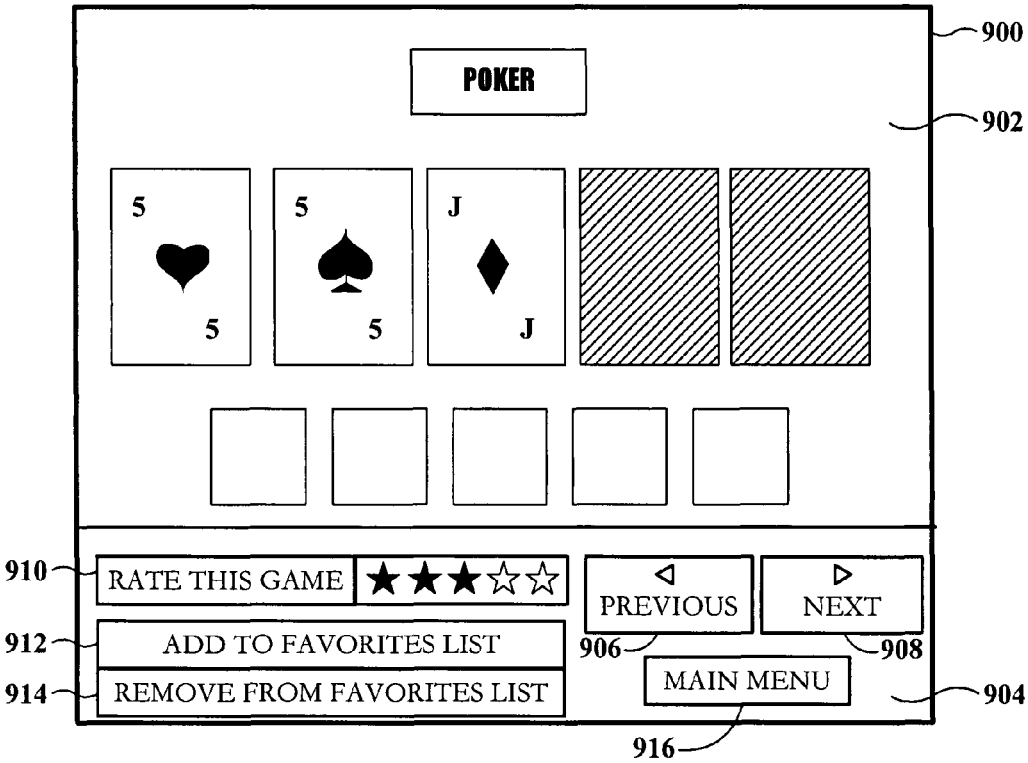
FIG. 9 illustrates an example user interface for game play using personal collections of gaming activities according to an embodiment of the present invention.

In reference now to FIG. 9, a gaming display 900 includes features for list usage and management according to an embodiment of the invention. The gaming display 900 includes a gaming area 902 where the graphics and/or controls of the particular game are shown. The gaming area 902 may be formed as a display frame or virtual display, so that games can be played without having to modify the code of the game to include additional features relating to collections of activities. Generally, a separate list control area 904 may be used to provide list control features.

The list control area 904 may be implemented as a toolbar, menu, or other graphical user interface (GUI) element. Generally, the player need not interact with the list control area 904 while playing, unless desiring to change some aspect relating to the playing of multiple gaming activities in succession. For example, if desired, the player may use previous and next controls 906, 908 to manually move forward or backwards in the current list sequence. A rating control 910 allows the player to see a star rating previously applied to the game (if any) and set or modify the rating during play. The player may be able to add a game to a running list using control 912 (assuming the player is not currently operating from within a saved list) or delete a game from a currently operative list using control 914. It will be appreciated that controls 912, 914 may be disabled or hidden depending on the mode. For example, if the currently running game is already in the player's currently loaded game list, then the add control 912 may be disabled. Finally, the list control area 904 may include a control 916 that allows the player to leave game play and go back to the main menu (e.g., screen 602 in FIG. 6).

Figure 10:
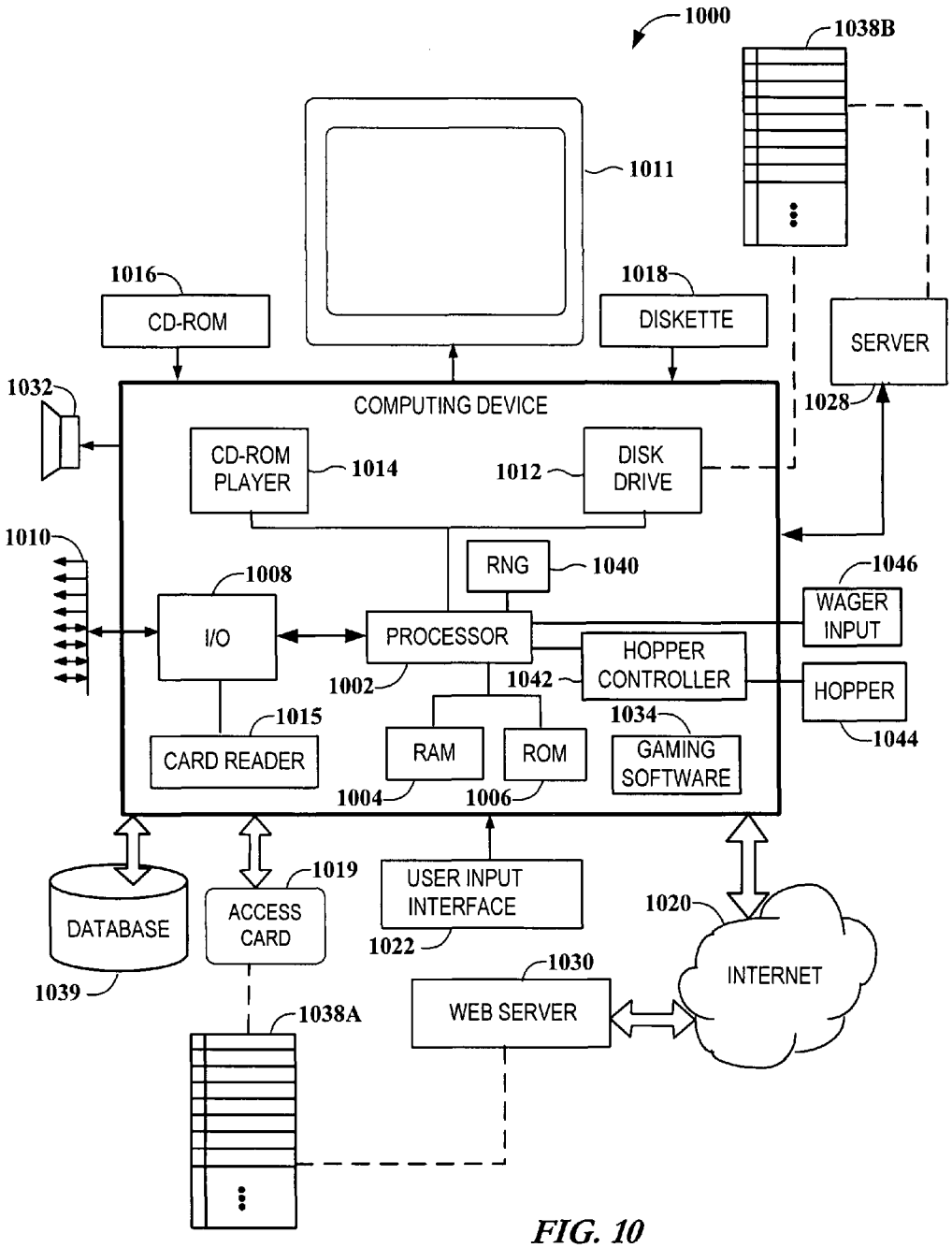
FIG. 10 illustrates a representative computing arrangement capable of carrying out operations in accordance with an embodiment the invention.

As may now be readily understood, a device may be programmed to play various embodiments of the invention. The present invention may be implemented as a casino gaming machine such as a slot machine or other special purpose gaming kiosk as described in FIG. 6, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 10.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 1000 of FIG. 10 is an example computing structure that can be used in connection with such electronic gaming machines, computers, or other computer-implemented devices to carry out operations of the present invention.

The example computing arrangement 1000 suitable for performing the gaming functions in accordance with the present invention typically includes a central processor (CPU) 1002 coupled to random access memory (RAM) 1004 and some variation of read-only memory (ROM) 1006. The ROM 1006 may also represent other types of storage media to store programs, such as programmable ROM (PROM), erasable PROM (EPROM), etc. The processor 1002 may communicate with other internal and external components through input/output (I/O) circuitry 1008 and bussing 1010, to provide control signals, communication signals, and the like.

Chance-based gaming systems such as slot machines, in which the present invention is applicable, are governed by random numbers and processors. A display device 1011 is used to display the gaming activity as facilitated by a random number generator (RNG). RNGs are well-known in the art, and may be implemented using hardware, software operable in connection with the processor 1002, or some combination of hardware and software. The present invention is operable using any known RNG, and may be integrally programmed as part of the processor 1002 operation, or alternatively may be a separate RNG controller 1040.

The computing arrangement 1000 may also include one or more data storage devices, including hard and floppy disk drives 1012, CD-ROM drives 1014, card reader 1015, and other hardware capable of reading and/or storing information such as DVD, etc. In one embodiment, software for carrying out the operations in accordance with the present invention may be stored and distributed on a CD-ROM 1016, diskette 1018, access card 1019, or other form of media capable of portably storing information. These storage media may be inserted into, and read by, devices such as the CD-ROM drive 1014, the disk drive 1012, card reader 1015, etc. The software may also be transmitted to the computing arrangement 1000 via data signals, such as being downloaded electronically via a network, such as the Internet 1020. Further, as previously described, the software for carrying out the functions associated with the present invention may alternatively be stored in internal memory/storage of the computing device 1000, such as in the ROM 1006.

The computing arrangement 1000 is coupled to the display 1011, which represents a display on which the gaming activities in accordance with the invention are presented. The display 1011 represents the "presentation" of the video information in accordance with the invention, and may be any type of known display or presentation screen, such as LCD displays, plasma display, cathode ray tubes (CRT), digital light processing (DLP), liquid crystal on silicon (LCOS), etc. Where the computing device 1000 represents a stand-alone or networked computer, the display 1011 may represent a standard computer terminal or display capable of displaying multiple windows, frames, etc. Where the computing device is embedded within an electronic gaming machine (see FIG. 6), the display 1011 corresponds to the display screen of the gaming machine/kiosk. A user input interface 1022 such as a mouse, keyboard/keypad, microphone, touch pad, trackball, joystick, touch screen, voice-recognition system, etc. may be provided. The display 1011 may also act as a user input device, e.g., where the display 1011 is a touchscreen device.

The computing arrangement 1000 may be connected to other computing devices or gaming machines, such as via a network. The computing arrangement 1000 may be connected to a network server 1028 in an intranet or local network configuration. The computer may further be part of a larger network configuration as in a global area network (GAN) such as the Internet 1020. In such a case, the computer may have access to one or more web servers 1030 via the Internet 1020.

Among other functions, the computing arrangement 1000 provides an interactive experience to players via input interface 1022 and output devices, such as the display 1011, speaker 1032, etc. These experiences are generally controlled by gaming software 1034. The gaming software 1034 may be temporarily loaded into RAM 1004, and may be stored locally using any combination of ROM 1006, drives 1012, or media player 1014. The gaming software 1034 may also be accessed remotely, such as via the server 1028 or the Internet 1020. In one embodiment, the gaming software 1034 includes facilities to access a plurality of individual gaming activities, and to allow player-configurable collections of those activities to be created and managed.

The collections of gaming activities, as represented by lists 1038A and 1038B, can be persistently stored on a local storage of the computing arrangement 1000 (e.g., drive 1012), storage of the server 1028, a local or remotely accessible database 1039, Web server 1030 (or similar function coupled to the Internet 1020), and/or removable persistent storage such as access card 1019. The gaming software 1034 (or similar software running on the arrangement 1000) allows a player to create, modify, and utilize the lists 1038A-B via the computing arrangement 1000 as described herein.

Other components directed to gaming machine implementations include manners of gaming participant payment, and gaming machine payout. For example, a gaming machine including the computing arrangement 1000 may also include a hopper controller 1042 to determine the amount of payout to be provided to the participant. The hopper controller may be integrally implemented with the processor 1002, or alternatively as a separate hopper controller 1042. A hopper 1044 may also be provided in gaming machine embodiments, where the hopper serves as the mechanism holding the coins/tokens of the machine. The wager input module 1046 represents any mechanism for accepting coins, tokens, coupons, bills, electronic fund transfer (EFT), tickets, credit cards, smart cards, membership cards, etc., for which a participant inputs a wager amount.

Figure 11:
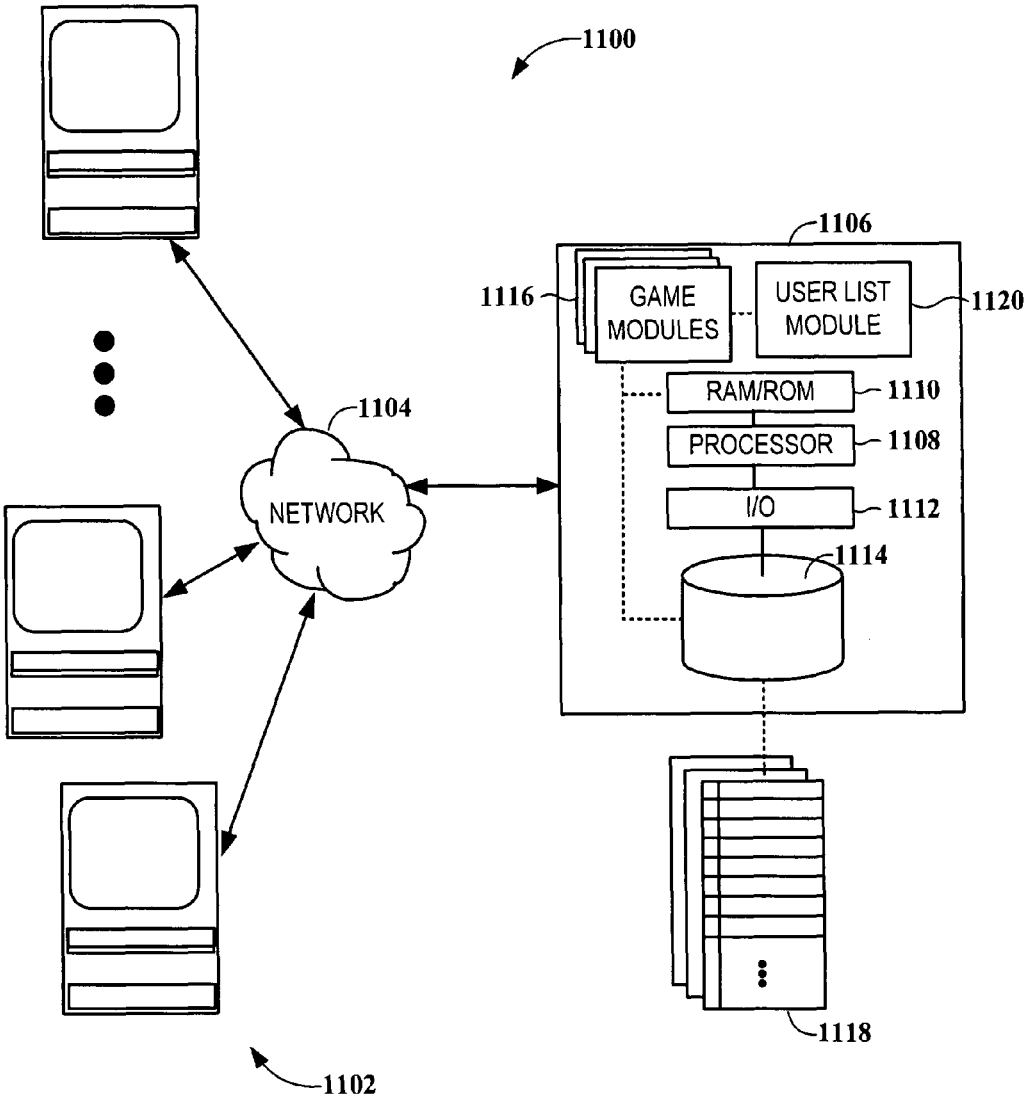
FIG. 11 illustrates a representative computing system capable of carrying out operations in accordance with an embodiment the invention.

The computing arrangement 1000 may be implemented as a stand-alone gaming machine, such as where all of the functionality is contained within a single apparatus. In other arrangements, the computing arrangement 1000 may be implemented as a system of computers, generally coupled together by a network. A more particular example of such a system 1100 according to an embodiment of the invention is shown in FIG. 11. The system 1100 is capable of supporting a plurality of gaming machines 1102 that are coupled together via one or more networks 1104. The system 1100 includes a server element 1106 is a centrally accessible network entity that may support gaming activities, including the provision of games and support of user configurable collections of gaming activities.

The server 1106 may include any combination of apparatuses known in the art. The server 1106 may be implemented as a single computing device, or as a collection of computing devices. The server 1106 generally includes one or more processors 1108, volatile and non-volatile memory 1110, I/O circuitry 1112, and magnetic or optical data storage 1114. The server 1106 may act as a repository for some or all of the games that are playable on the gaming machines 1102. This is represented by gaming modules 1116. The gaming modules 1116 may be libraries or other executable images that are compatible with the processing hardware on the gaming machines 1102. In such an arrangement, the modules 1116 may be uploaded to the gaming machines 1102 at run-time and/or boot-time. In other implementations, the gaming modules 1116 may execute on the server 1106, and the gaming machines 1102 are configured acting as network-coupled input-output devices. In this latter arrangement, the gaming machines 1102 act as terminal devices, and may be configured to operate without any onboard disk storage or operating systems.

The server 1106 also includes a user list module 1120 that enables the use of player-configurable collections 1118 to access the gaming modules 1116. The user list module 1120 may provide the user interface necessary for players to create, maintain and use individual collections 1118. The user list module 1120 may also contain the functionality that enables efficient storage and maintenance of large numbers of collections 1118. For example, the user list module 1120 may include a relational database interface (not shown) that allows large-scale, high-reliability access to structured data.

Figure 12:
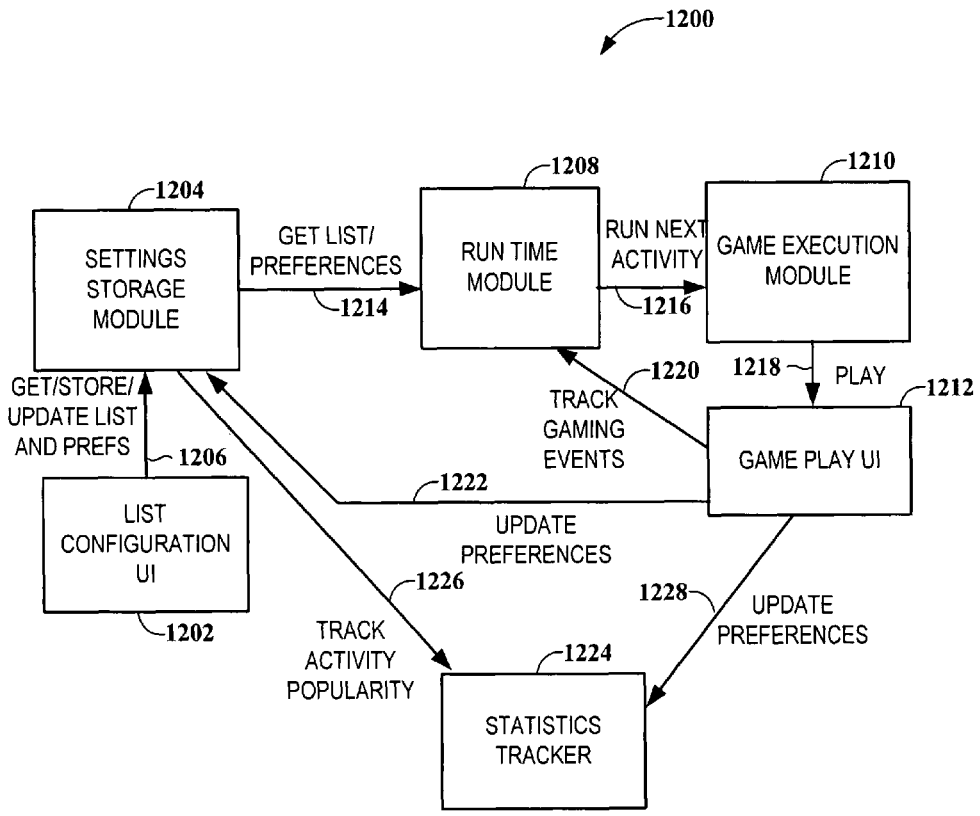
FIG. 12 is a software component diagram illustrating functional modules and interactions therebetween in accordance with an embodiment the invention.

It will be appreciated that the gaming functionality described herein may be implemented on any combination of hardware and software, as well as any combination of standalone apparatus and networked systems. A more particular description of the functionality according to an embodiment of the invention is shown in the software component diagram 1200 in FIG. 12. These components 1200 may be implemented as a single executable running on a single machine, or may be multiple processes/threads that are distributed over a local-area, wide-area, or global-area network.

The components 1200 can be roughly divided into three general functional areas. One of these functional areas involves the creation and maintenance of collections, as represented by the list configuration UI module 1202. The list configuration UI 1202 provides a user interface that allows players to view, create, change, and delete collections of gaming activities. The list configuration UI 1202 interfaces with a settings storage module 1204 for retrieving, storing, and changing (path 1206) persistent user data. This persistent data may include the collections/lists themselves, as well as other user preference data.

The second general functional area relates to the playing of gaming activities. This functional area is represented by a run-time module 1208, a game execution module 1210, and a game play UI 1212. The run-time module 1208 governs the overall sequencing of particular gaming activities. As such the run-time module 1208 will access (path 1214) the particular user-defined collections and other preferences associated with a particular player. The run-time module 1208 also interfaces with the game execution module 1210 in order to instruct (path 1216) the game execution module 1210 on which gaming activities to run.

The game execution module 1210 deals with managing the location and requirement of individual games referenced in the user-defined collections. The games may be contained in the collections themselves, or may exist elsewhere on local or remote computing elements. The game execution module 1210 accesses executable images of gaming activities, provides a run-time environment for those activities (e.g., allocates memory, provides display context, locates and loads common libraries, etc.), and enables the games to be played (path 1218) via the game play UI 1212.

The game play UI 1212 may act a "shell" program that ultimately runs the games. The game itself may include a separately executable image that can run independently of the game play UI 1212. However, the games and the game play UI 1212 may include application program interfaces (API) that allow certain aspects of the game to be tracked by the game play UI 1212. For example, the number of game events may be tracked and input (path 1220) to the run-time module 1208. The run-time module 1208 may use this tracked data 1220 in order to determine when it is time to trigger 1216 a different activity.

The game play UI 1212 may also provide a user interface display and/or hardware interface that operates independently of the games themselves. This user interface may also generate events that are sent (path 1220) to the run-time module 1208, such as a request by the player to proceed to the next activity 1216, or to access a configuration menu. The game play UI 1212 may also allow real-time update (path 1222) of user preferences (e.g., ranking of a gaming activity) for storage via the settings module 1204.

The third functional area of the components 1200 relates to back-end monitoring and processing of system data, as represented by the statistics tracker 1224. The statistics tracker 1224 may, for example, track popularity of gaming activities by way of user settings (path 1126) or by real-time ratings (path 1228). The statistics tracker 1224 may monitor a wide variety of short term and long term system data, including system logs, software failure tracking, usage statistics, system performance, indicators of system compromise, etc.

The foregoing description of the exemplary embodiments of the invention has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of the gaming activities. It is intended that the scope of the invention be limited not with this detailed description, but rather determined from the claims appended hereto.

What is claimed is:

1. A method of providing wagering activities via a gaming machine, comprising:

facilitating, via a user interface, player identification of a set of gaming activities capable of being played on the gaming machine;

assigning, via one or more processors, a collection of references to the set of the gaming activities, wherein each of the references refers to at least one of the gaming activities of the set of gaming activities identified by the player;

storing the collection of references in a computer-readable medium readable by the one or more processors;

facilitating player access to the set of gaming activities by way of the one or more processors retrieving from the computer-readable medium the stored collection of references; and progressing the sequence based on a playing time of the gaming activities of the sequence.

2. A method of providing wagering activities via a gaming machine, comprising:

facilitating, via a user interface, player identification of a set of gaming activities capable of being played on the gaming machine;

assigning, via one or more processors, a collection of references to the set of the gaming activities, wherein each of the references refers to at least one of the gaming activities of the set of gaming activities identified by the player;

storing the collection of references in a computer-readable medium readable by the one or more processors;

facilitating player access to the set of gaming activities by way of the one or more processors retrieving from the computer-readable medium the stored collection of references; and progressing the sequence based on a player input indicating desire to progress the sequence.

3. A method of providing wagering activities via a gaming machine, comprising:

facilitating, via a user interface, player identification of a set of gaming activities capable of being played on the gaming machine;

assigning, via one or more processors, a collection of references to the set of the gaming activities, wherein each of the references refers to at least one of the gaming activities of the set of gaming activities identified by the player;

storing the collection of references in a computer-readable medium readable by the one or more processors;

facilitating player access to the set of gaming activities by way of the one or more processors retrieving from the computer-readable medium the stored collection of references; and progressing the sequence based on a predetermined event occurring within the gaming activities of the sequence.

4. The method of claim 3, wherein the predetermined event comprises a predetermined number of completed play events within each gaming activity.

5. The method of claim 3, wherein the completed number of predetermined number of completed play events within each gaming activity comprises a variable number of events that is varied based on an order of the gaming activity within the sequence.

6. The method of claim 3, wherein the predetermined event comprises a predetermined number of win-loss events within each gaming activity.

7. A casino gaming apparatus hosting a gaming activity, comprising:

a human input and output capable of providing player access to a plurality of gaming activities;

a processor coupled to the human input and output; and a memory coupled to the processor, the memory having instructions that cause the processor to, facilitate selection by the player of a collection of references to gaming activities playable on the apparatus to create a player-defined collection of the gaming activities, wherein each of the references refers to at least one of the gaming activities, wherein the player has selected the gaming activities from a set of gaming activities and stored the references to the selected gaming activities in a computer-readable medium;

access the collection of references from the computer-readable medium;

facilitate player access to the player-defined collection of the gaming activities via the human input and output using the accessed collection of references; and sequence between individual ones of the selected gaming activities based on a playing time of the selected gaming activities.

8. A casino gaming apparatus hosting a gaming activity, comprising:

a human input and output capable of providing player access to a plurality of gaming activities;

a processor coupled to the human input and output; and a memory coupled to the processor, the memory having instructions that cause the processor to, facilitate selection by the player of a collection of references to gaming activities playable on the apparatus to create a player-defined collection of the gaming activities, wherein each of the references refers to at least one of the gaming activities, wherein the player has selected the gaming activities from a set of gaming activities and stored the references to the selected gaming activities in a computer-readable medium;

access the collection of references from the computer-readable medium;

facilitate player access to the player-defined collection of the gaming activities via the human input and output using the accessed collection of references; and sequence between individual ones of the selected gaming activities based on predetermined events occurring within the selected gaming activities.

* * * * *